US006165106A

United States Patent [19]

McBride et al.

[11] Patent Number: 6,165,106

[45] Date of Patent: Dec. 26, 2000

[54] RECREATION DECK WITH CENTRAL LOAD BEARING MEMBER

[75] Inventors: Brandon McBride, Langston; Kim Blackwood, Blountsville; Wesley Sutton, Fort Payne, all of Ala.

[73] Assignee: Playcore, Inc., Janesville, Wis.

[21] Appl. No.: 09/233,966

[22] Filed: Jan. 20, 1999

[51] Int. Cl.[7] ..... A63B 17/00

[52] U.S. Cl. ..... 482/35; 482/36; 52/650.3

[58] Field of Search ..... 52/650.3, 651; 182/116, 106, 113; 472/116, 118, 126, 136, 137; 482/38, 36

[56] References Cited

U.S. PATENT DOCUMENTS

| | | | |
|---|---|---|---|
| D. 246,005 | 10/1977 | Callecod . | |
| D. 260,108 | 8/1981 | Ament et al. | D21/245 |
| D. 302,198 | 7/1989 | Mercer . | |
| D. 303,280 | 9/1989 | Mercer . | |
| D. 347,568 | 6/1994 | Siragusa, Jr. et al. . | |
| D. 358,085 | 5/1995 | Siragusa, Jr. et al. . | |
| 4,068,842 | 1/1978 | Callecod . | |
| 4,159,113 | 6/1979 | Callecod . | |
| 4,262,900 | 4/1981 | Vinson . | |
| 4,941,658 | 7/1990 | Poo . | |

OTHER PUBLICATIONS

1997 Gametime Park and Playground Catalog front cover, pp. 2–3, 22–23, 32–33, 44–45, back cover.

1998 Gametime Park and Playground Catalog pages front cover, Table of Contents (2 pages),14–17, 24–25, 30–31, 56–57, back cover.

Fun Things for Kids, 1998 Park & Playground Equipment Catalogue, Miracle Recreation Equipment Catalogue, Jan. 1998.

*Primary Examiner*—Jerome Donnelly

*Attorney, Agent, or Firm*—Welsh & Katz, Ltd.

[57] ABSTRACT

The present invention is a recreation deck. The recreation deck has a plurality of posts which support a platform. The supported platform defines a center, and has a load-bearing member independent of the posts. The load bearing member connects to and supports the platform at the center.

3 Claims, 3 Drawing Sheets

RECREATION DECK WITH CENTRAL LOAD BEARING MEMBER

BACKGROUND

This invention relates to park and playground equipment, and more particularly climbing equipment and elevated play environments. Children need playground equipment that provides a durable, safe, varied, and creative play environment. Various types of playground equipment are known in the art, the vast majority of which are intended to be used as stand-alone structure dedicated to one purpose. These traditional forms of playground equipment include see-saws, climbers, slides, spring mounted riders, whirls and the like. Another playground structure is a traditional playground deck. These decks are simple elevated spaces, usually accessed by a ladder or staircase attached to the deck, with no central supporting member. Rather, these decks are supported by corner columns or posts in accordance with traditional accepted building practices.

One way of achieving a superior play environment is to provide an environment where access to the deck is centrally located and is a part of the permanent structure. This arrangement provides novel design opportunities as a result of such incorporated function. Since the center of the deck can act as an entrance to the deck, the sides of the deck can be used for alternate entrances or exits, access to other elevated play equipment, or stationary play stations. Alternate entrances and exits give children more avenues of play. A play area with multiple types of equipment near each other and connected to each other allows children to switch activities as their attention spans expire.

Accordingly, there is a need for playground equipment of modular construction that is capable of serving in conjunction with other suitable apparatus to make a superior play environment for children. A play environment made of modular, interchangeable stations, each of the stations being made of modular parts allows the construction of large scale play apparatus more economically than known, non-modular, stand-alone structures.

SUMMARY

This present invention addresses the need for a recreational deck that can be coordinated with other modular playground equipment to provide a durable, safe, varied, and creative play environment. A climbing and playing deck having the features of the present invention includes a platform, supported on the periphery by posts, and supported in the center by a load-bearing member.

In a preferred embodiment the platform is made up of polygonal deck plates that are the same shape and size and connect to form a regular polygon. When the platform or play surface is a regular polygon and the posts are positioned at the vertices of the regular polygon, the symmetrical structure more readily fits into a standardized plan for a larger play environment than an irregularly shaped structure.

Another feature of the preferred embodiments is that the posts support the platform by attaching to the periphery of the platform, and the load-bearing member supports the center of the platform by being attached to the center. Most preferably the central support is a ladder that provides a climbing structure. When the central support is a ladder, a central fence makes the deck safer to play on.

As is shown in the preferred embodiments, the play area around the base of the deck can be expanded when the supporting posts are curved underneath the deck.

Another feature of the preferred embodiments is the modular connectors that connect to the posts that permit the deck to be easily accessorized to provide a creative, varied play environment. A varied play environment is also advanced by attaching peripheral play equipment to the panels that form the platform.

DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
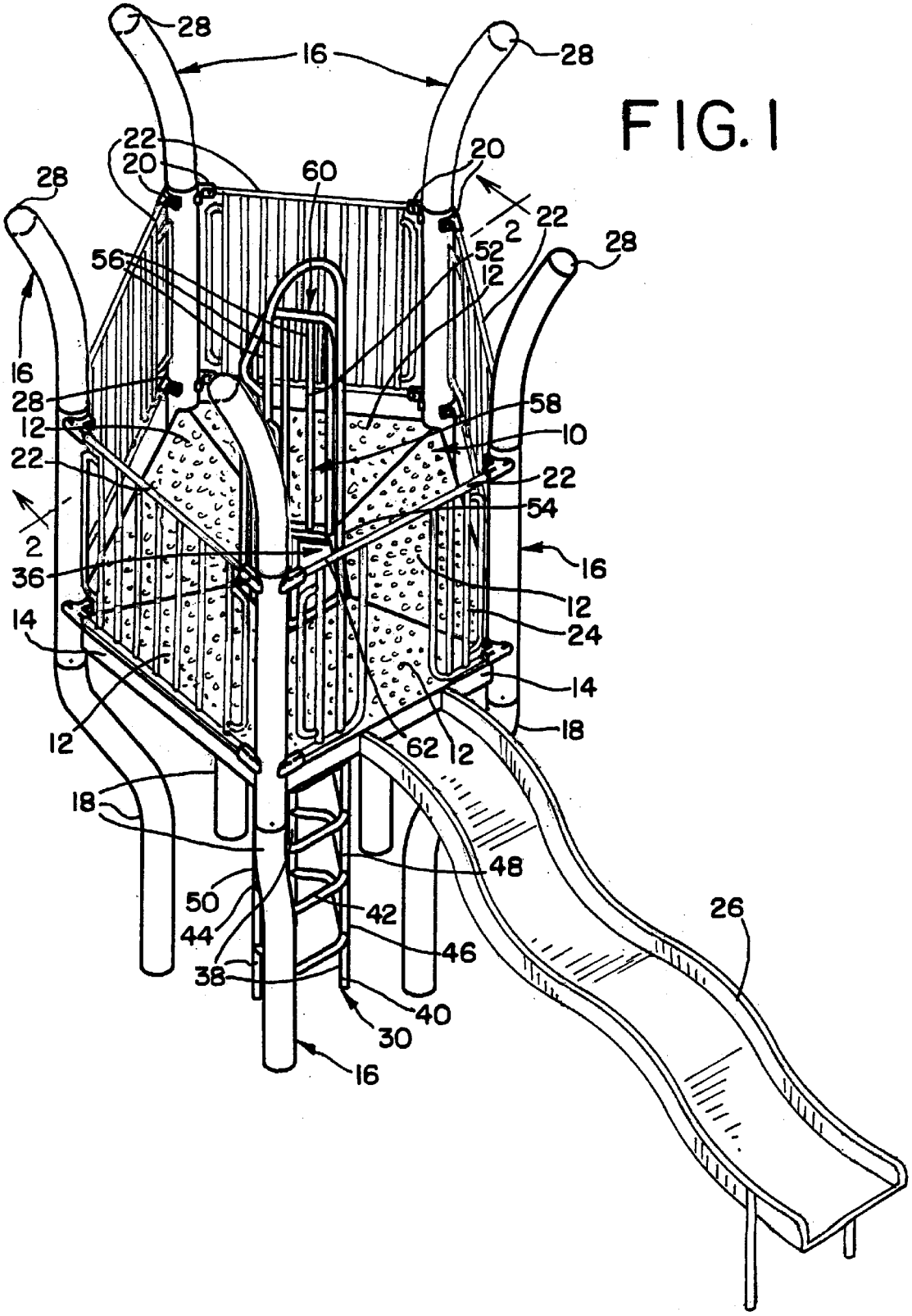
FIG. 1 is a perspective view of a polygonal deck having a centrally disposed load-bearing ladder embodying the principles of the present invention, the deck being shown as a regular pentagon and illustrated with an optional slide mounted thereto.

While the present invention is susceptible of embodiment in various forms, there is shown in the drawings and will be hereinafter be described preferred embodiments with the understanding that the present disclosure is to be considered an exemplification of the invention and is not intended to limit the invention to the specific embodiments illustrated.

Figure 2:
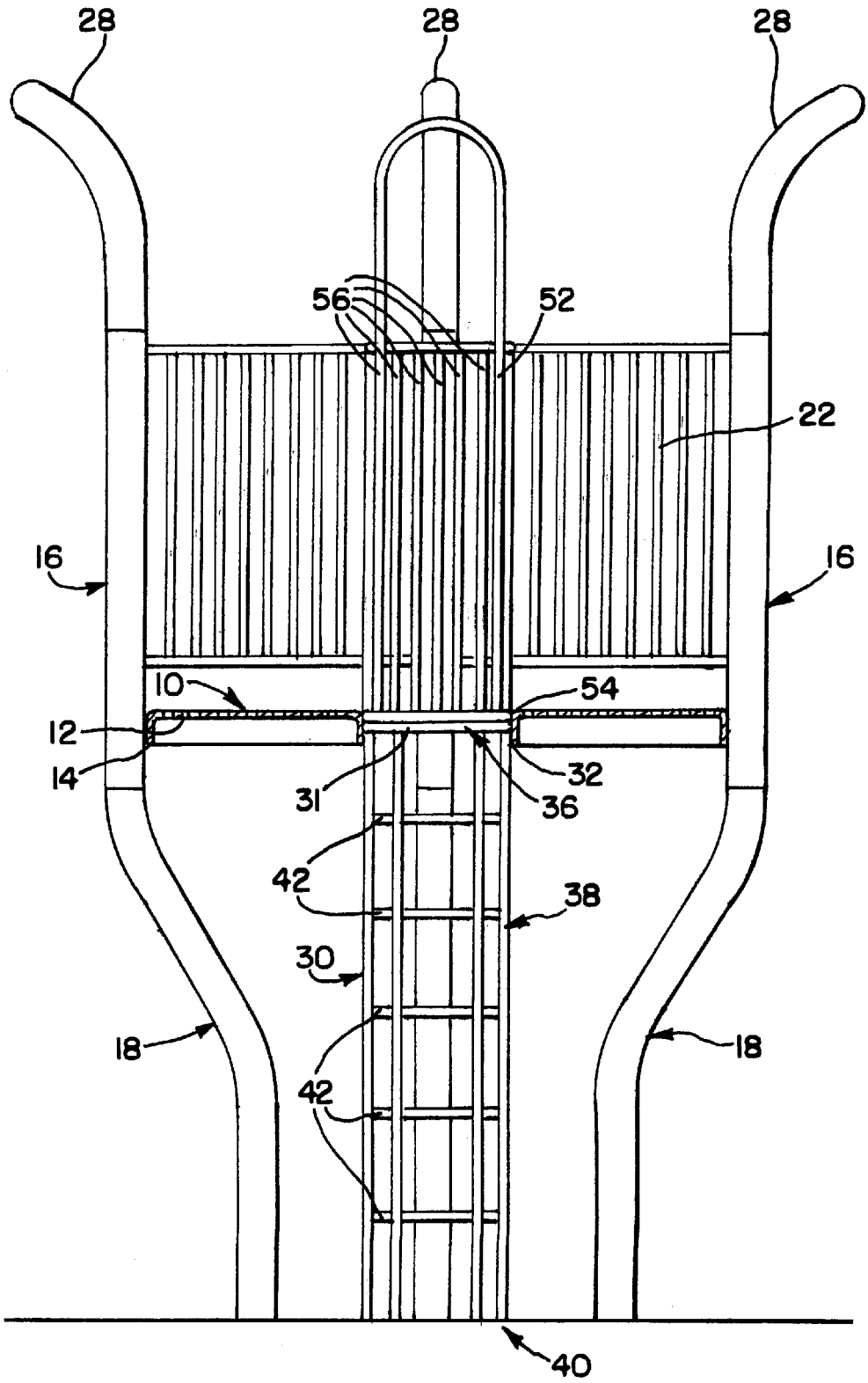
FIG. 2 is a cross-sectional view of a deck as taken along line 2—2 of FIG. 1.
Figure 3:
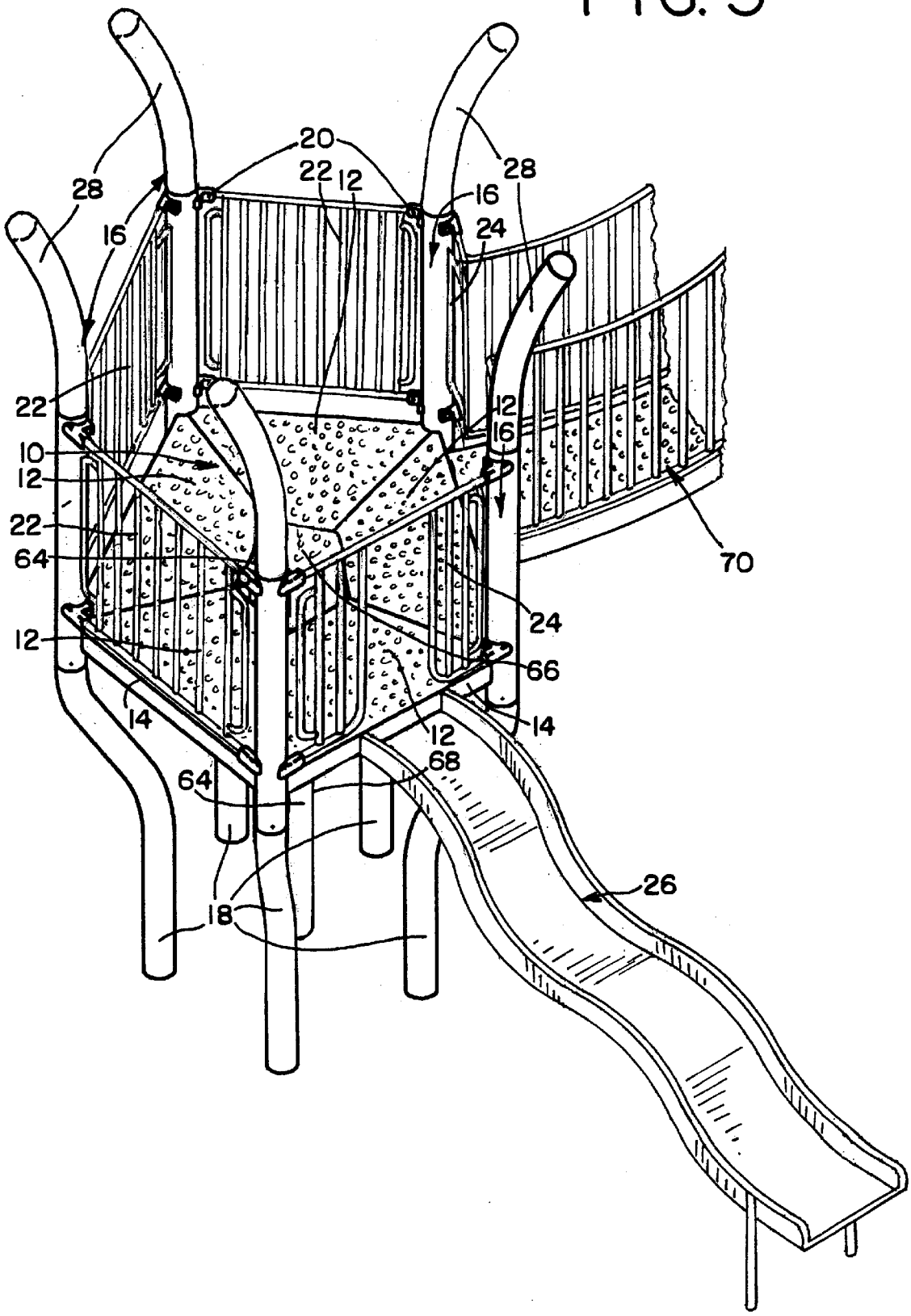
FIG. 3 shows a perspective of a deck where the load bearing member includes a panel and a central vertical post extending to the ground.

Referring to FIGS. 1–3, a recreation deck of this invention has a platform supported by a plurality of posts and a substantially centrally disposed load-bearing member. The preferred embodiment of the platform, which serves as a play surface, is formed from a plurality of substantially trapezoidal panels that define a polygonal opening in the center of the polygonal platform. The play platform is connected to and supported by posts, or elevating members, and the central load bearing member. The posts have connectors to connect to and support the platform at a level elevated above grade around the periphery of the platform. The platform defines a central open area that is supported by the load bearing member. The load bearing member connects to each panel and maintains each panel abutted to its adjacent panels. The load bearing member further supports the platform both vertically and laterally. Typically the bottoms of the posts will be set in concrete or some other durable anchoring material to improve the stability of the platform and keep the deck stable during even the most vigorous play.

FIG. 1 illustrates a preferred embodiment of the recreation deck. The deck is a pentagonal platform 10 formed from five substantially identical trapezoidal panels 12. The panels 12 each have depending side flanges 14. The flanges 14 are preferably adapted for attaching stairs, slides, or other play equipment with fasteners, such as bolts and the like. Desirably, the panels have arcs formed in the corners at the post connections that match the radius of the posts. This form-fit of the posts minimizes gaps and facilitates more stable connections. The trapezoidal panels 12 are preferably made of polyvinylchloride coated steel plates with an array of small holes in the steel to allow light and water to pass through. Those skilled in the art will recognize that a wide variety of metallic and non-metallic structural and coating materials can be used to make the platform, which variations are within the scope of the present invention.

The deck of FIG. 1 has posts 16 which are adapted to have two panels 12 bolted to each post. Other arrangements of the panels 12 and the posts 16 will be apparent to those skilled in the art. In a preferred embodiment, the posts 16 curve underneath the platform 10 so that more area around the deck at grade level is available for the children to play, and so that the posts can be set in a common footing with less concrete than would otherwise be needed to set the posts. When arranged as shown in FIG. 1, the lower end 18 of the posts 16 provide an additional variation in the play environment for children to react to creatively.

The illustrated embodiment of the invention includes modular connectors 20 for mounting accessories to the posts 16 which connectors are of the type of the type described in U.S. Pat. Nos. D347,568 and D358,085, to Siragusa, Jr. et al., which patents are commonly assigned herewith, and which are incorporated by reference herein. Accessories to the deck can be positioned around the platform by being attached to those posts. One commonly used accessory is a fence 22 that can be attached in sections, to keep children from falling from the deck. Game panels, not shown, are also used to both confine and entertain children. Other desirable accessories include gates 24 to allow children egress to attached play components while providing additional handholds for safer play. The play components may be attached to either the modular connectors 20 or the flanges 14 of the panels 12. Examples of such play components are slides, bridges, crawl tubes, stairs, climbers, horizontal or vertical ladders and other decks. The deck depicted in FIG. 1 shows a recreational deck with a wave slide 26 attached to a flange of a platform panel, a gate 24 for access to the slide that is attached to the posts near the slide, and safety fences 22 attached between the remaining posts.

The tops 28 of the posts 16 shown in FIG. 1 are curved to accentuate the attractiveness of the play environment and not interfere in play, but could easily be straight and capped without an upper extension just above the height where the modular connectors 20 are located. If the posts 16 include a hollow tube with an attached cap, the tilted angle of the top cap tends to direct any possible leaks away from the insides of the hollow tubes. The posts 16 are preferably made of either aluminum or galvanized steel but can be made of any material sufficiently strong to safely bear the weight of the deck and the children. Optionally, although not shown, the deck can be topped by a roof to provide shade or protection from the general environs.

The load-bearing ladder 30 of FIG. 1 may be more clearly seen in FIG. 2. The ladder portion from the plate connection 32 downward defines the load-bearing ladder 30. In the preferred embodiment, the top of the load-bearing ladder 30 has a substantially polygonal head 34 which is shaped to fit and connect to the opening 36 defined by the platform 10. The head 34 fastens to each of the panels 12 on the faces of the panels 12 which define the opening. As can be seen in FIGS. 1 and 2, the illustrated embodiment has a head 34 having a substantially pentagonal shape. The load-bearing ladder 30 has three vertical members 38 which extend from the ground up to the opening 36 in the platform 38. The three vertical members 38 are placed approximately in an equilateral triangle, attached to the head 34 and extend along about two-thirds of the head. The bottom of the load-bearing ladder 40 can be set in a single footing of sufficient size to support all three members, or the vertical member can be set in individual footings. The footings are typically made of concrete or another settable material that provides structural rigidity and stability to the structure. Rungs 42 extend from the first vertical member 44 to the second vertical member 46 and from the second vertical member to the third vertical member 48, defining an entrance 50 between the first and the third vertical members. The rungs 42 in FIG. 1 are constructed to mimic the size and shape of the opening in the platform, and form a partial, e.g. two-thirds, polygon. The result is a wide load-bearing ladder 30 with rungs 42 that present an obtuse angle for climbing. A load-bearing ladder 30 with this arrangement is easily climbable by children. Variations on this load-bearing ladder 30 will be apparent to those skilled in the art, which variations include extending the load-bearing ladder 30 up beyond the opening 36. These and other variations are encompassed by the scope of this invention.

In FIGS. 1 and 2, extending above the load-bearing ladder 30 is a central fence 52 having a substantially polygonal base 54 that is shaped to fit the opening 36 defined by the platform 10. The base 54 is fastened to each of the panels 12 at the flanges 14 that define the opening 36. The base 54 is substantially identical and connected to the head 34 of the load-bearing ladder 30. The central fence 52 includes a plurality of fence members 56 which serve both as hand holds for the rising climber, and as a fence to prevent children on the platform from falling down through the opening. The fence members 56 are positioned so as to define an exit 58 from the load-bearing ladder 30 by which the children may emerge onto the platform.

The central fence 52 shown is pentagonal with four substantially closed sides 62 and one open side 62. The illustrated deck has the exit 58 positioned above the rungs 42 of the ladder 30. In the illustrated geometry there is inevitably some overlap of the central fence 52 over the entrance 50 below since the entrance is about one third of the ladder cross-section, and the exit is only one fifth of the central fence cross 52 section. Preferably, this exit 58 is positioned so that when a child climbs onto the load-bearing ladder 30 up to the platform that child arrives facing the exit 58. Thus, that child can climb safely off of the ladder without having to make any awkward turns while climbing. The load-bearing ladder 30 and central fence 52 are preferably made of painted galvanized steel tubing, but may be made of any material sufficiently strong to support the center of the deck and any children on the deck and the load-bearing ladder. The spacing of the rungs should be appropriately scaled to the children who are intended to play on the deck.

The recreational deck depicted in FIG. 3 illustrates an alternate embodiment. Like the mbodiment of FIGS. 1 and 2, the embodiment of FIG. 3. has a pentagonal platform 10 formed from five substantially trapezoidal panels 12. The panels 12 again define a pentagonal opening 36. In the deck of FIG. 3, the deck has a support member 64 in the center of the platform connected to the surrounding trapezoidal panels. The support member 64 has a pentagonal panel 66 that connects to and supports the trapezoidal panels 12, the pentagonal panel 66 being of a construction similar to the panels of the embodiment depicted in FIGS. 1 and 2. The support member 64 includes a vertical member 68 that extends from the pentagonal panel 66 to the ground. The vertical member 68 is typically set in a concrete footing to provide further stability to the deck. The deck of FIG. 3 is shown with a deck with a wave slide 26, a gate 24, and fences 22 similar to the deck in FIG. 1. The deck is also shown with a bridge 70 that extends to another recreational equipment structure attached to the posts 16 and the flange 14 of a panel.

Although the present invention has been described in considerable detail with reference to certain preferred embodiments thereof, other embodiments will present themselves to those skilled in the art. For example, the deck could easily be four sided or six sided, or rivets could be used instead of bolts. Therefore the spirit and scope of the appended claims should not be limited to the description of the preferred embodiments contained herein.

We claim:

1. A recreation deck comprising:

a plurality of posts, the posts curving underneath a platform, at least one post being capable of attaching to an associated play accessory;

wherein the platform defines a center and a periphery, the platform being polygonal thereby defining vertices at the corners thereof, and wherein the platform is supported by the plurality of posts at respective vertices of the polygonal deck, the platform being formed from a plurality of polygonal panels, the polygonal panels being identical to one another and joined to adjacent panels to form a regular polygon, at least one polygonal panel having a flange for attaching to an associated play accessory; and a load-bearing member, independent of the posts, which connects to and supports the platform at the center.

2. A recreation deck as in claim 1 wherein the load-bearing member comprises a ladder.

3. A recreation deck as in claim 2 wherein the ladder is substantially open.

* * * * *